United States Patent [19]

Finnegan

[11] 4,082,303

[45] Apr. 4, 1978

[54] RELEASABLE-STRAP SKI-POLE GRIP

[75] Inventor: Robert J. Finnegan, Williston, Vt.

[73] Assignee: Barreca Products Co., Subsidiary of Shelburne Industries, Inc., Shelburne, Vt.

[21] Appl. No.: 764,848

[22] Filed: Feb. 2, 1977

[51] Int. Cl.[2] ..... A63C 11/22

[52] U.S. Cl. ..... 280/11.37 H

[58] Field of Search ..... 280/11.37 H, 11.37 D; 224/45 P, 45 S; 135/45 R; 30/340, 125

[56] References Cited

U.S. PATENT DOCUMENTS

| | | | |
|---|---|---|---|
| 3,368,811 | 2/1968 | Finney | 280/11.37 H X |
| 3,662,433 | 5/1972 | Couttet | 280/11.37 H X |
| 3,880,443 | 4/1975 | Tobin | 280/11.37 H |
| 3,992,021 | 11/1976 | Tobin | 280/11.37 H |
| 4,005,872 | 2/1977 | Rischert | 280/11.37 H |

*Primary Examiner*—Joseph F. Peters, Jr.
*Assistant Examiner*—Gene A. Church
*Attorney, Agent, or Firm*—Hopgood, Calimafde, Kalil, Blaustein & Lieberman

[57] ABSTRACT

The invention contemplates a releasable-strap ski-pole grip comprising a single injection-molded piece of flexibly yieldable material having a hand-grip body portion to fit the end of a ski pole, and also having integrally formed upper and lower strap portions which provide radially offset longitudinally approaching ends. These ends carry releasably engageable hook-and-loop tape elements which enable adjustable setting of the strap connection, to suit the comfort and size of a particular gloved hand, and the nature of the connection is to release upon accidental wrenching of the hand with respect to the grip, the release being automatic whatever the degree of adjustment.

9 Claims, 8 Drawing Figures

RELEASABLE-STRAP SKI-POLE GRIP

The invention relates to a releasable-strap ski-pole grip which provides assuring support during normal skiing use but which is automatically releasable in an emergency.

It is an object of the invention to provide an improved ski-pole grip of the character indicated.

It is a specific object to provide such a grip with releasable strip means which (a) is adjustable, in the sense that it can be applied to hold the knuckles of the hand to the gripped pole, regardless of the bulk or size of the gloved hand of the user (within a range of user sizes), and which (b) is automatically releasable in the event of an emergency jolt to the pole with respect to the hand.

It is also an object to provide such a grip affording the utmost facility of pole manipulation in normal skiing, and at the same time affording the utmost protection against injury, through ready automatic releasability.

A general object is to meet the foregoing objects with a grip of elemental simplicity, reliability and ease of adjustment.

Other objects and various further features of novelty and invention will be pointed out or will occur to those skilled in the art from a reading of the following specification, in conjunction with the accompanying drawings. In said drawings, which show, for illustrative purposes only, a preferred form of the invention:

Figure 1:
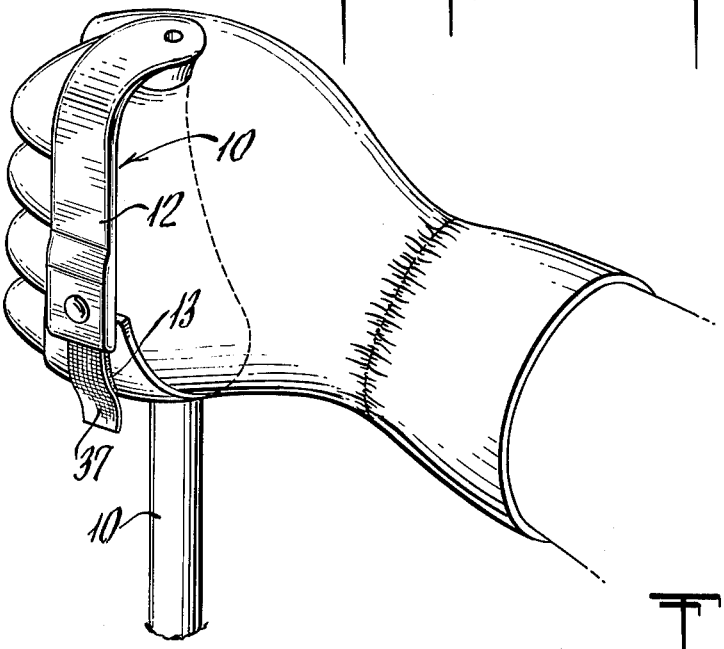
FIG. 1 is a perspective view of the gloved hand of a skier, using a ski pole equipped with a releasable-strap grip of the invention.
Figure 4:
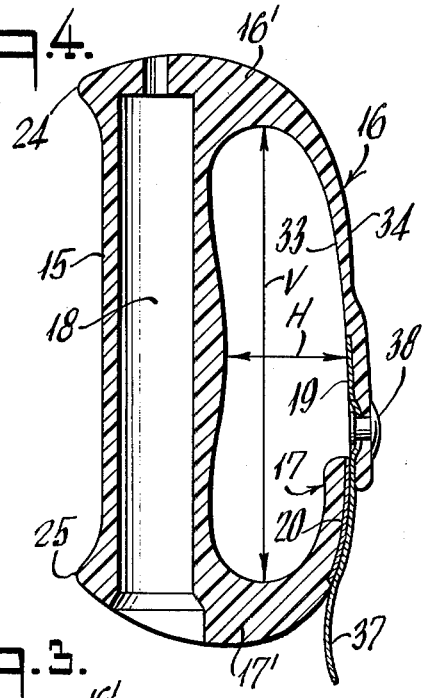
Figure 3:
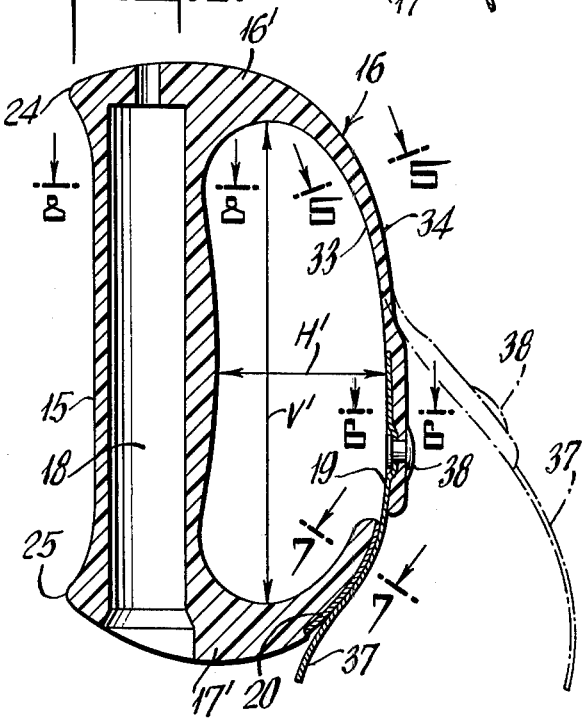
FIG. 3 is a sectional view, taken at the plane 3—3 of FIG. 2.

FIG. 4 is a view in side elevation, for the aspect of FIG. 3, but illustrating a different adjusted relationship; and FIGS. 5, 6, 7 and 8 are sectional views taken at alignments 5—5, 6—6, 7—7, and 8—8 of FIG. 3.

The invention is shown in application to a grip 10 fixed to the end of a ski pole 11 and having adjustably engaged strap members 12–13 for releasably holding the back of the gloved knuckles of a left hand to the body of the grip. Preferably, the grip 10 is almost entirely of one piece, being injection-molded of flexibly yieldable material, such as rubber or plastic, and I have found polyvinylchloride, of durometer 60 on the Shore-A scale, to be very satisfactory. This single piece comprises an upstanding hand-grip body portion 15, and upper and lower strip portions 16–17 integral with said body portion. The body portion 15 has an elongate bore 18 for assembly to the pole 11, and the strap portions 16–17 extend at 16′–17′ in substantially the same radial-offsetting direction from the upper and lower ends of the body portion. The strap portions 16–17 also extend longitudinally toward each other, terminating at discrete adjacent ends, the upper strap portion 16 being of the greater longitudinal extent, preferably sufficient for coverage of the knuckles of the second, third and fourth fingers, leaving only the knuckle region of the little finger to be engaged by the lower strap portion 17. Adjustable and releasable engagement of strap portions 16–17 is effected by hook-and-loop tape elements 19–20 respectively carried by the inner surface of one strap portion and by the outer surface of the other strap portion.

Figure 2:
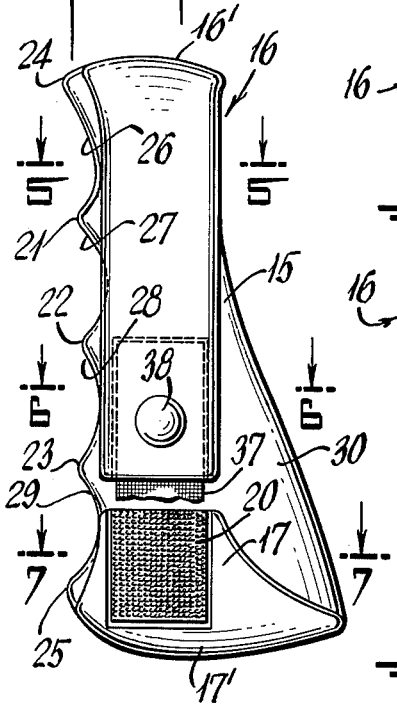
FIG. 2 is an enlarged view in elevation of the grip of FIG. 1, the view being toward the strap side of the grip.

More particularly, the grip body portion is seen to be contoured for individual finger-locating reference, being characterized by plural spaced radial projections 21-22-23 between flange-like enlargements 24–25 of the strap portions 16–17, at juncture with body portion 15. As best seen in FIG. 2, finger-locating cusps 26-27-28-29 are defined between successive projections 24-21-22-23-25, and these projections are oriented substantially normal to the radial direction of offsets 16′–17′. Body portion 15 is also characterized by a palm-engageable projection 30 which is of enlarging radial extent, in approach to and juncture with the lower strap offset 17′, the latter being of substantially the maximum radial extent of the palm-engageable projection 30, for extensive and comfortable support of the hand. In turn, the skier's thumb derives longitudinal reference to the grip, beneath the flange-like projection 24 at the upper end of body portion 15 and generally opposite the upper offset 16′.

Figure 5:
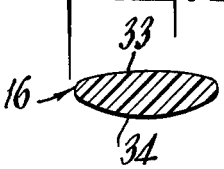
Figure 6:
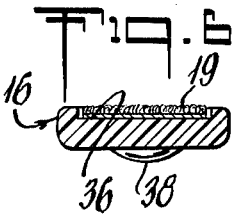
Figure 7:
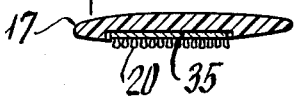
Figure 8:
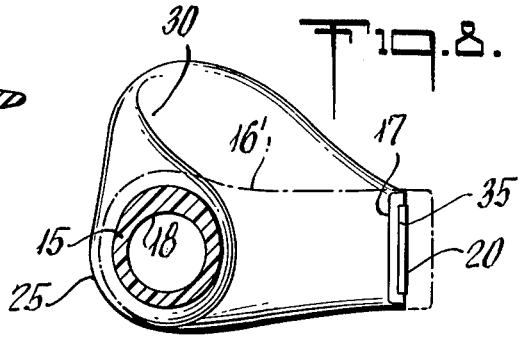

From the sectional views of FIGS. 5, 6 and 7, the strap portions are seen to be relatively broad, presenting in the case of strap portion 16 a smooth inner surface 33 for engagement at or near the knuckles, and a correspondingly broad outer face 34. The thickness of each strap portion is reduced in approach to its releasably connectable end, and a minimum thickness (and therefore maximum radially outwardly bendable region) is provided in the upper strap portion 16, in the generally upper region at which section 5—5 is taken.

The hook-and-loop tape means 19–20 for releasable connection of the ends of strap portions 16–17 may be a commercially available product known as Velcro, being a product of Velcro Corporation, of New York City. Preferably, the hook-characterized tape element is at 20, being bonded to a locally recessed region 35 of the outer face of lower strap portion 17, and the total length of element 20 being thus bonded in conformance with the outer contour of the end of strap portion 17. At the same time, the loop-characterized tape element 19 is selected for length substantially in excess of the recess 36 in which it is secured to the inner face 33 of strap portion 16, thus leaving a downwardly projecting pull tab 37 for easier setting and manual release of a selected hook-and-loop engagement. Tape bonding at 35–36 may employ suitable adhesive, such as cynanoacrylate, and I find it desirable to provide additional security for the pull tab 37, using a rivet or grommet fastening at 38. For the hook-and-loop tapes, I have obtained highly satisfactory results using the Velcro No. 65 hook material at 19 and a standard napped loop material at 20, providing a length-wise shear resistance of at least 5 pounds per square inch, and a tension or latching effect of 5 pounds per square inch; with these materials, the strap-bonded lengths are each about 1 inch for a width of 0.80 inch.

In use, the skier's gloved hand (in the form shown, the left hand), is inserted between strap portions 16–17 and body portion 15 to the point of secure finger grasp at 15. If a correct strap setting had already been established, the skier is ready for normal skiing. If he is wearing a different pair of gloves or otherwise feels the need for readjustment, he first pulls tab 37 outwardly to separate the hook-and-loop engagement, and then he applies a firm downward pull to deflect the upper offset 16′ tightly around his gripping fist, bringing tab 37 around the underside of his fist, for reestablishment of the new hook-and-loop engagement. FIG. 4 illustrates a more limited vertical span V and horizontal span H for a reduced adjusted setting, as compared with the larger corresponding dimensions V'-H' in FIG. 3 for a more bulky fist grip. But whatever the adjustment at which the strap portions are secured, the hook-and-loop fastening means responds to an emergency jerk or wrench of the hand or pole, to release the strap connection, allowing the hand to be free of any pole injury.

The described ski grip will be seen to have achieved all stated objects. The grip is strong, and the hook-and-loop fastening lends itself to repeated release and resetting. The skier achieves the maximum in satisfying connection to and control of his pole for normal skiing, but safe release is at once available in an emergency, whatever the strap setting.

While the invention has been described in detail for the preferred form shown, it will be understood that modifications may be made without departure from the scope of the invention.

What is claimed is:

1. A releasable-strap ski-pole grip, comprising a single injection-molded piece of flexibly yieldable material having an upstanding hand-grip body portion and upper and lower strap portions integral with said body portion, said body portion having an elongate bore for assembly to the upper end of a ski pole, said strap portions respectively extending in substantially the same radial offsetting direction from the upper and lower ends of said body portion, and said strap portions also extending longitudinally toward each other and to discrete adjacent ends, said strap portions having inner and outer relatively broad faces which are radially spaced from each other and with respect to the bore axis; and hook-and-loop releasably engageable tape-fastener means including a first tape element secured to the inner face of one of said strap portions near the longitudinally projecting end thereof, and a second tape element secured to the outer face of the other strap portion near the longitudinally projecting end thereof.

2. The ski-pole grip of claim 1, in which said upper strap portion is of longitudinally greater extent than said lower strap portion, and in which said first tape element is secured to said upper strap portion.

3. The ski-pole grip of claim 1, in which one of said tape elements extends longitudinally beyond the longitudinal end of the strap portion to which it is secured.

4. The ski-pole grip of claim 1, in which said body portion includes a finger-locating profile of spaced radial projections at an angular location which is generally normal to the direction of strap-portion offset from said body portion.

5. The ski-pole grip of claim 2, in which said first tape element is loop-characterized and said second tape element is hook-characterized.

6. The ski-pole grip of claim 1, in which each of said strap portions is characterized by a locally recessed surface at the region in which its tape element is secured thereto.

7. The ski-pole grip of claim 2, in which said upper strap portion includes a relatively thin and therefore locally more flexible region upwardly of the tape-secured end of said upper strap portion.

8. The ski-pole grip of claim 4, in which said body portion further includes a palm-engageable projection in the direction generally opposed to said finger-locating profile, said palm-engageable projection being of increasing radial extent in the direction of approach to and juncture with said lower strap portion.

9. The ski-pole grip of claim 8, in which said lower strap portion is of substantially the maximum radially projecting extent as that of said palm-engageable projection, for substantially the radially offsetting region of said lower strap portion.

* * * * *